US010676856B2

(12) United States Patent
Woodham, Jr. et al.

(10) Patent No.: US 10,676,856 B2
(45) Date of Patent: Jun. 9, 2020

(54) DOOR ASSEMBLY FOR A WASHING MACHINE APPLIANCE

(71) Applicant: Haier US Appliance Solutions, Inc., Wilmington, DE (US)

(72) Inventors: Richard Gary Woodham, Jr., Taylorsville, KY (US); Bryan James Beckley, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 244 days.

(21) Appl. No.: 15/697,519

(22) Filed: Sep. 7, 2017

(65) Prior Publication Data

US 2019/0071815 A1 Mar. 7, 2019

(51) Int. Cl.

| | |
|---|---|
| ***D06F 39/14*** | (2006.01) |
| ***D06F 37/28*** | (2006.01) |
| ***D06F 37/10*** | (2006.01) |
| *D06F 37/18* | (2006.01) |
| *D06F 39/12* | (2006.01) |
| *D06F 39/08* | (2006.01) |

(52) U.S. Cl.

CPC ..... *D06F 39/14* (2013.01); *D06F 37/10* (2013.01); *D06F 37/28* (2013.01); *D06F 37/18* (2013.01); *D06F 39/088* (2013.01); *D06F 39/12* (2013.01)

(58) Field of Classification Search

CPC ..... D06F 37/28; D06F 39/14; D06F 37/10

See application file for complete search history.

(56) References Cited

U.S. PATENT DOCUMENTS

| | | | | |
|---|---|---|---|---|
| 7,814,768 | B2 * | 10/2010 | Vecchi | D06F 19/00 134/1 |
| 8,549,887 | B2 * | 10/2013 | Reid | B08B 3/12 68/3 R |
| 2005/0183208 | A1 | 8/2005 | Scheper et al. | |
| 2006/0053842 | A1 * | 3/2006 | Je | D06F 39/02 68/17 R |
| 2007/0107138 | A1 | 5/2007 | Bernardino | |
| 2013/0002113 | A1 * | 1/2013 | Loss | D06F 37/28 312/291 |
| 2015/0211167 | A1 * | 7/2015 | Kim | D06F 31/00 68/140 |
| 2015/0252508 | A1 * | 9/2015 | Kim | D06F 29/00 68/27 |

(Continued)

FOREIGN PATENT DOCUMENTS

| | | | |
|---|---|---|---|
| EP | 2415920 | B1 | 5/2013 |
| WO | WO2017026770 | A1 | 2/2017 |
| WO | WO2017039185 | A1 | 3/2017 |

*Primary Examiner* — Joseph L. Perrin

(74) *Attorney, Agent, or Firm* — Dority & Manning, P.A.

(57) ABSTRACT

A door assembly for a horizontal axis washing machine includes a door rotatably mounted to a front panel to permit selective access to an opening of the washing machine appliance. A sub-door is rotatably mounted to the door and is movable between an open position and a closed position. The sub-door defines a pretreat basin for collecting wash fluid from a wash fluid supply when the sub-door is in the open position for pretreating an article of clothing. After the pretreatment procedure is complete, the sub-door may be pivoted toward the closed position such that the article of clothing and the collected wash fluid are passed directly into the tub through a door opening and drain conduit.

17 Claims, 5 Drawing Sheets

(56) References Cited

U.S. PATENT DOCUMENTS

| | | | | |
|---|---|---|---|---|
| 2015/0292135 | A1* | 10/2015 | Wishney | D06F 37/10 68/139 |
| 2015/0299927 | A1* | 10/2015 | Kim | D06F 31/00 68/27 |
| 2016/0369445 | A1 | 12/2016 | Kim et al. | |
| 2017/0137985 | A1* | 5/2017 | Kim | D06F 37/28 |
| 2017/0183803 | A1* | 6/2017 | Kim | D06F 37/28 |
| 2019/0010657 | A1* | 1/2019 | Uim | D06F 37/42 |
| 2019/0186062 | A1* | 6/2019 | Park | D06F 37/40 |

* cited by examiner

DOOR ASSEMBLY FOR A WASHING MACHINE APPLIANCE

FIELD OF THE INVENTION

The present subject matter relates generally to door assemblies for washing machine appliances, or more specifically, to door assemblies including features facilitating the pretreatment of articles of clothing.

BACKGROUND OF THE INVENTION

Washing machine appliances generally include a tub for containing water or wash fluid, e.g., water and detergent, bleach, and/or other wash additives. A basket is rotatably mounted within the tub and defines a wash chamber for receipt of articles for washing. During normal operation of such washing machine appliances, the wash fluid is directed into the tub and onto articles within the wash chamber of the basket. The basket or an agitation element can rotate at various speeds to agitate articles within the wash chamber, to wring wash fluid from articles within the wash chamber, etc.

One issue with many conventional washing machine appliances is that consumers have no place to pretreat articles before washing. In many conventional washing machine appliances, there is not an adequate surface or component on which to perform pretreat activities. Accordingly, such activities must be performed in a separate utility sink, a kitchen sink, or in another suitable location using apparatus separate from the washing machine appliance. In addition, such pretreatment activities require a separate, dedicated source of pretreatment detergent, water, or other wash fluid for applying to the clothing during the pretreatment process. This can be inconvenient and time-consuming for the consumer.

Accordingly, a washing machine appliance having improved features for pretreating articles of clothing is desirable. More particularly, a washing machine appliance with an integrated pretreating platform or surface and features for supplying a wash fluid onto the articles of clothing during a pretreatment process would be particularly beneficial.

BRIEF DESCRIPTION OF THE INVENTION

The present subject matter provides a door assembly for a horizontal axis washing machine that includes a door rotatably mounted to a front panel to permit selective access to an opening of the washing machine appliance. A sub-door is rotatably mounted to the door and is movable between an open position and a closed position. The sub-door defines a pretreat basin for collecting wash fluid from a wash fluid supply when the sub-door is in the open position for pretreating an article of clothing. After the pretreatment procedure is complete, the sub-door may be pivoted toward the closed position such that the article of clothing and the collected wash fluid are passed directly into the tub through a door opening and drain conduit. Aspects and advantages of the invention will be set forth in part in the following description, or may be apparent from the description, or may be learned through practice of the invention.

In accordance with one exemplary embodiment of the present disclosure, a washing machine appliance defining a vertical, a lateral, and a transverse direction is provided. The washing machine appliance includes a cabinet including a front panel that defines an opening. A tub is positioned within the cabinet and a wash basket is rotatably mounted within the tub, the wash basket defining a wash chamber for receiving articles for washing. A door assembly is positioned proximate the opening and includes a door rotatably mounted to the front panel to permit selective access to the opening. A sub-door is rotatably mounted to the door and being movable between an open position and a closed position, the sub-door defining a pretreat basin for collecting wash fluid when the sub-door is in the open position. A wash fluid supply is configured for selectively supplying a flow of wash fluid into the pretreat basin.

In accordance with another exemplary embodiment of the present disclosure, a door assembly for a horizontal axis washing machine is provided. The washing machine includes a cabinet including a front panel defining an opening and a tub positioned within the cabinet. The door assembly includes a door rotatably mounted to the front panel to permit selective access to the opening and a sub-door rotatably mounted to the door and being movable between an open position and a closed position, the sub-door defining a pretreat basin for collecting wash fluid when the sub-door is in the open position. A wash fluid supply is configured for selectively supplying a flow of wash fluid into the pretreat basin.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
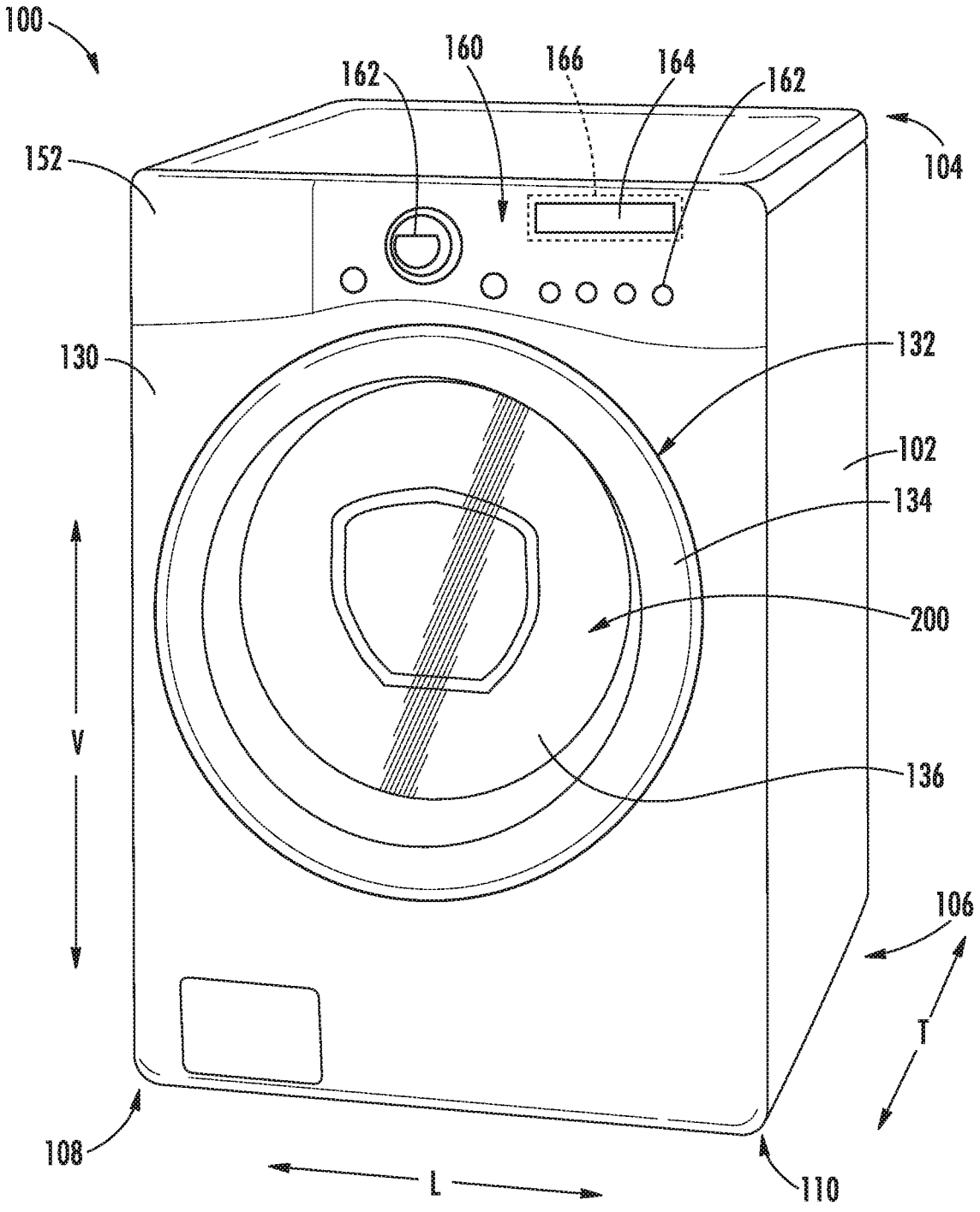
FIG. 1 provides a perspective view of an exemplary washing machine appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
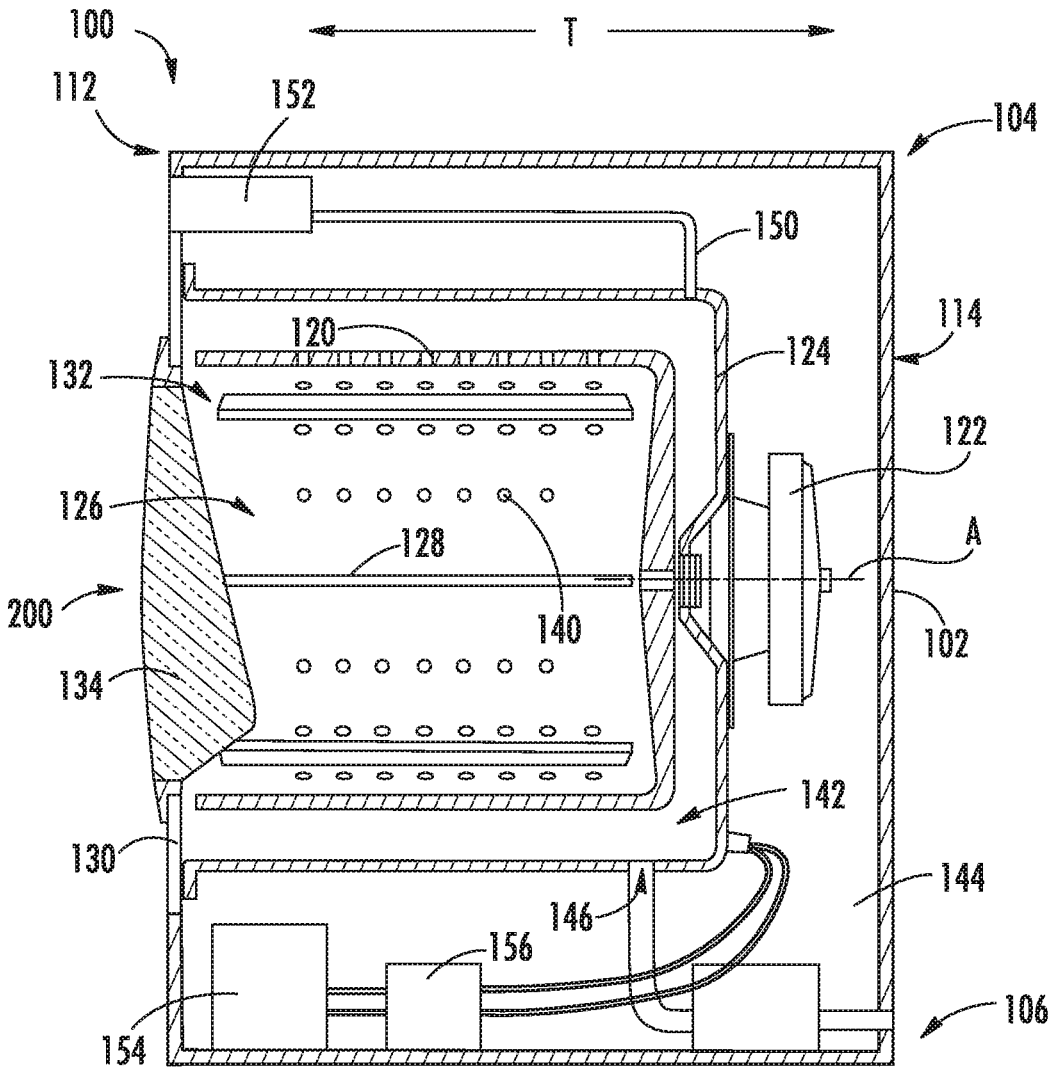
FIG. 2 provides a side cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction, and between a front 112 and a rear 114 along the transverse direction T.

Referring to FIG. 2, a wash basket 120 is rotatably mounted within cabinet 102 such that it is rotatable about an axis of rotation A. A motor 122, e.g., such as a pancake motor, is in mechanical communication with wash basket 120 to selectively rotate wash basket 120 (e.g., during an agitation or a rinse cycle of washing machine appliance 100). Wash basket 120 is received within a wash tub 124 and defines a wash chamber 126 that is configured for receipt of articles for washing. The wash tub 124 holds wash and rinse fluids for agitation in wash basket 120 within wash tub 124. As used herein, "wash fluid" may refer to water, detergent, fabric softener, bleach, or any other suitable wash additive or combination thereof.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Referring generally to FIGS. 1 and 2, cabinet 102 also includes a front panel 130 which defines an opening 132 that permits user access to wash basket 120 of wash tub 124. More specifically, washing machine appliance 100 includes a door 134 (which may be part of a door assembly 200 as described in detail below) that is positioned over opening 132 and is rotatably mounted to front panel 130. More specifically, door 134 is rotatable about a door axis 202 (see FIG. 3) that is substantially parallel to the vertical direction V. In this manner, door 134 permits selective access to opening 132 by being movable between an open position (not shown) facilitating access to a wash tub 124 and a closed position (FIG. 1) prohibiting access to wash tub 124.

A window 136 in door 134 permits viewing of wash basket 120 when door 134 is in the closed position, e.g., during operation of washing machine appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments.

Referring again to FIG. 2, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of and generally collects wash fluid during operation of washing machine appliance 100. For example, during operation of washing machine appliance 100, wash fluid may be urged by gravity from basket 120 to sump 142 through plurality of perforations 140. A pump assembly 144 is located beneath tub 124 for gravity assisted flow when draining tub 124, e.g., via a drain 146. Pump assembly 144 is also configured for recirculating wash fluid within wash tub 124.

A spout 150 is configured for directing a flow of fluid into wash tub 124. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated in FIG. 2, a detergent drawer 152 is slidably mounted within front panel 130. Detergent drawer 152 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 152 may also be fluidly coupled to spout 150 to facilitate the complete and accurate dispensing of wash additive.

Additionally, a bulk reservoir 154 is disposed within cabinet 102. Bulk reservoir 154 is also configured for receipt of fluid additive for use during operation of washing machine appliance 100 (shown in FIG. 1). Bulk reservoir 154 is sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, and/or other items of interest to machine users.

Operation of washing machine appliance 100 is controlled by a controller or processing device 166 (FIG. 1) that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 160 and other components of washing machine appliance 100 may be in communication with controller 166 via one or more signal lines or shared communication busses.

During operation of washing machine appliance 100, laundry items are loaded into wash basket 120 through opening 132, and washing operation is initiated through operator manipulation of input selectors 162. Wash tub 124 is filled with water, detergent, and/or other fluid additives, e.g., via spout 150 and or detergent drawer 152. One or more valves (not shown) can be controlled by washing machine appliance 100 to provide for filling wash basket 120 to the appropriate level for the amount of articles being washed and/or rinsed. By way of example for a wash mode, once wash basket 120 is properly filled with fluid, the contents of wash basket 120 can be agitated (e.g., with ribs 128) for washing of laundry items in wash basket 120.

After the agitation phase of the wash cycle is completed, wash tub 124 can be drained. Laundry articles can then be rinsed by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle and/or after the rinse cycle in order to wring wash fluid from the articles being washed. During a spin cycle, basket 120 is rotated at relatively high speeds. After articles disposed in wash basket 120 are cleaned and/or washed, the user can remove the articles from wash basket 120, e.g., by opening door 134 and reaching into wash basket 120 through opening 132.

While described in the context of a specific embodiment of horizontal axis washing machine appliance 100, using the teachings disclosed herein it will be understood that horizontal axis washing machine appliance 100 is provided by way of example only. Other washing machine appliances having different configurations, different appearances, and/or different features may also be utilized with the present subject matter as well, e.g., vertical axis washing machine appliances. Moreover, aspects of the present subject matter may be used in any other consumer or commercial appliance where it is desirable to facilitate quick and easy application of a wash additive for a pretreat operation.

Referring now generally to FIGS. 2 through 6, a door assembly 200 will be described in more detail according to various exemplary embodiments of the present subject matter. Although the discussion below refers to door assembly 200, one skilled in the art will appreciate that the features and configurations described may be used for other door assemblies in other washing machine appliances as well. For example, door assembly 200 may be positioned in another location within cabinet 102 and may be configured for receiving any suitable wash fluid or fluids such as water, detergent, other additives, or mixtures thereof. Other variations and modifications of the exemplary embodiment described below are possible, and such variations are contemplated as within the scope of the present subject matter.

Figure 3:
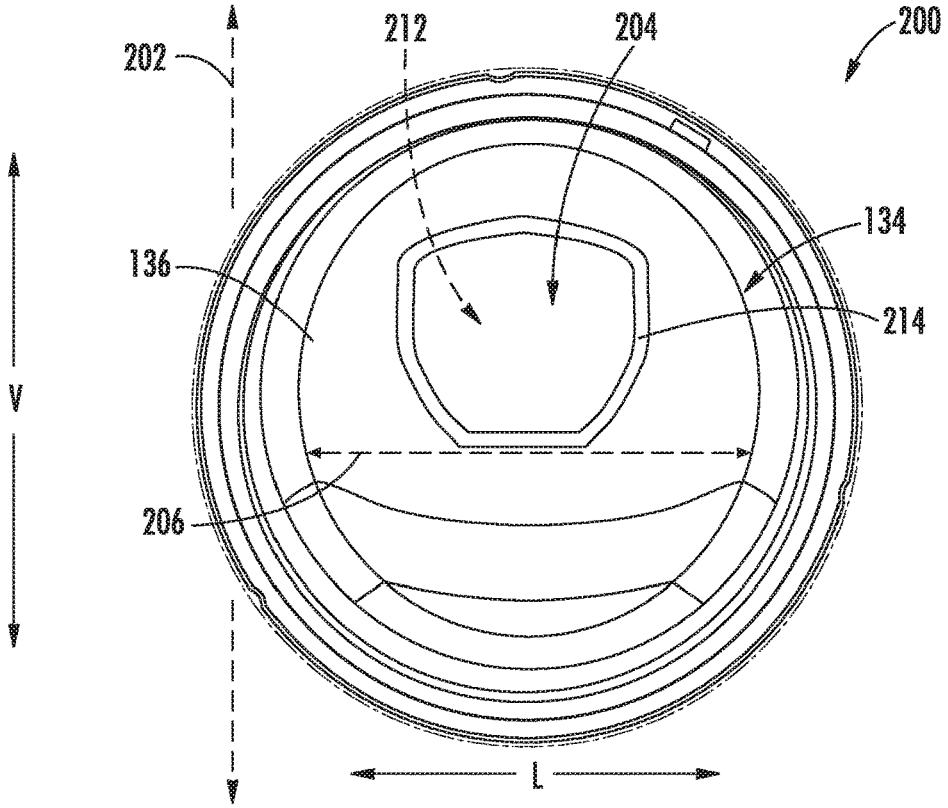
FIG. 3 provides a front view of a door assembly that may be used with the exemplary washing machine appliance of FIG. 1.
Figure 4:
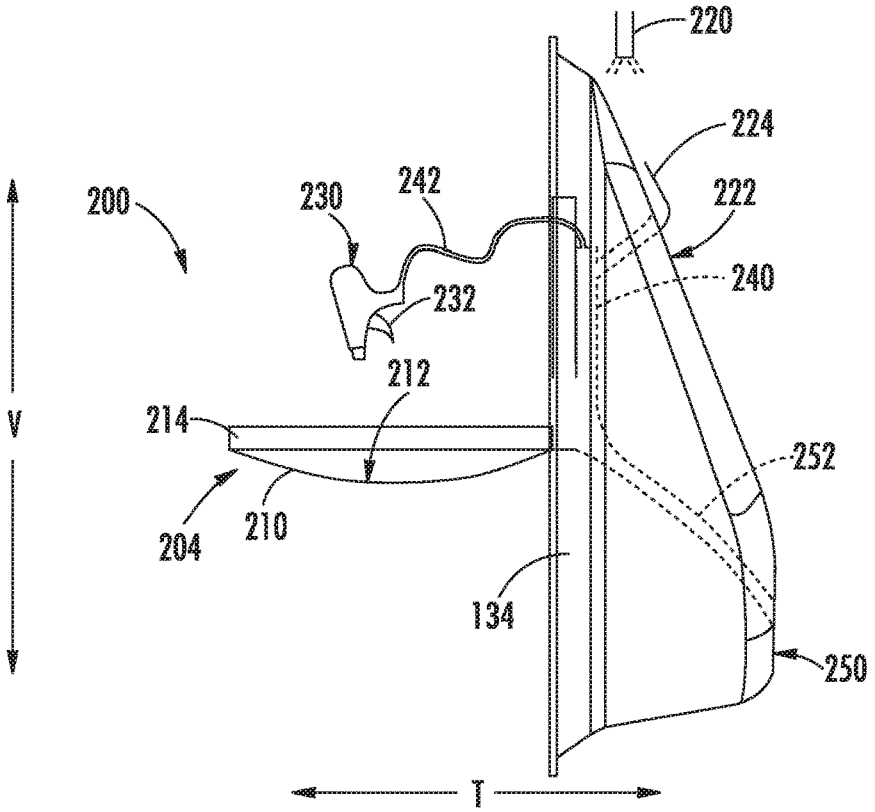
FIG. 4 provides a side view of the exemplary door assembly of FIG. 3 according to an exemplary embodiment of the present subject matter.

As shown in FIGS. 3 and 4 and described above, door assembly 200 includes door 134 which is positioned over opening 132 and is pivotable about a door axis 202 (FIG. 3). As also described above, door 134 may include window 136 to permit viewing of wash basket 120 when door 134 is in the closed position. According to the illustrated embodiment, door assembly 200 also includes a sub-door 204 rotatably mounted to door 134 (e.g., within window 136 according to the illustrated embodiment). Sub-door 204 is rotatable about a sub-door axis 206 such that it is movable an open position (e.g., a pretreat position) and a closed position (e.g., a wash position).

Sub-door 204 defines a pretreat basin 210 for pretreating one or more garments or articles of clothing prior to performing a wash cycle. Pretreat basin 210 is generally a surface that is configured for supporting an article of clothing and/or collecting an amount of pretreat wash fluid applied to that clothing. For example, according to the illustrated embodiment, door axis 202 is substantially parallel to the vertical direction V and sub-door axis 206 is substantially parallel to the lateral direction L. In this manner, when door 134 is in the closed positioned and sub-door 204 is open, sub-door 204 is in a substantially horizontal orientation (e.g., extends within a plane perpendicular to the vertical direction V).

As illustrated, pretreat basin 210 defines a upper, concave surface 212 when viewed looking down along the vertical direction V when sub-door 204 is in the open position. In this manner, pretreat basin 210 may collect and maintain a pretreatment additive, water, and/or another wash fluid during a pretreat process. During this process, the article of clothing may be submerged, manually agitated, scrubbed, or otherwise pretreated for stains. According to an exemplary embodiment, sub-door 204 and pretreat basin 210 may define additional surfaces, protrusions, ribs, bristles, or other features to facilitate improved pretreating action or scrubbing of articles. In alternative embodiments, however, concave surface 212 need not include such features. For example, it should be appreciated that according to alternative embodiments, pretreat basin 210 may simply be a flat, planar surface or any other vertical support member.

Sub-door 204 may further include a peripheral lip 214 which may extend around a periphery of pretreat basin 210, thus for example surrounding concave surface 212. When the sub-door 204 is in the open position, peripheral lip 214 may extend above concave surface 212 along the vertical direction V. Peripheral lip 214 may generally serve to contain wash fluid on or within pretreat basin 210.

Notably, door 134 and sub-door 204 may be formed from any suitable materials. For example, in some embodiments, door 134 and sub-door 204 may be formed from a plastic. More specifically, for example, door 134 and sub-door 204 may be injection molded, and may thus be formed from an injection molded material such as an injection molded plastic. Notably, the plastic may clear, e.g., to define window 136 or otherwise permit viewing of the wash basket 120 during operation of washing machine appliance 100.

To facilitate the pretreatment process, it is desirable to include features for providing a wash fluid or pretreatment agent onto an article of clothing positioned within pretreat basin 210. Thus, according to an exemplary embodiment, washing machine appliance 100 or door assembly 200 may further include a wash fluid supply 220 configured for selectively supplying a flow of wash fluid into pretreat basin 210. For example, according to the illustrated embodiment, wash fluid supply 220 is mounted within wash tub 124 above door 134 along the vertical direction V. Such a wash fluid supply 220 may be used, for example, to spray wash fluid on a back wall 222 of door 134 during a fill cycle of washing machine appliance 100, e.g., to indicate to a user that water is being added by spout 150. Although wash fluid supply 220 is described herein as supplying "wash fluid," it should be appreciated that wash fluid supply 220 may be configured for supplying water, detergent, bleach, fabric softener, or any other wash additive to facilitate the pretreatment of clothing.

Figure 5:
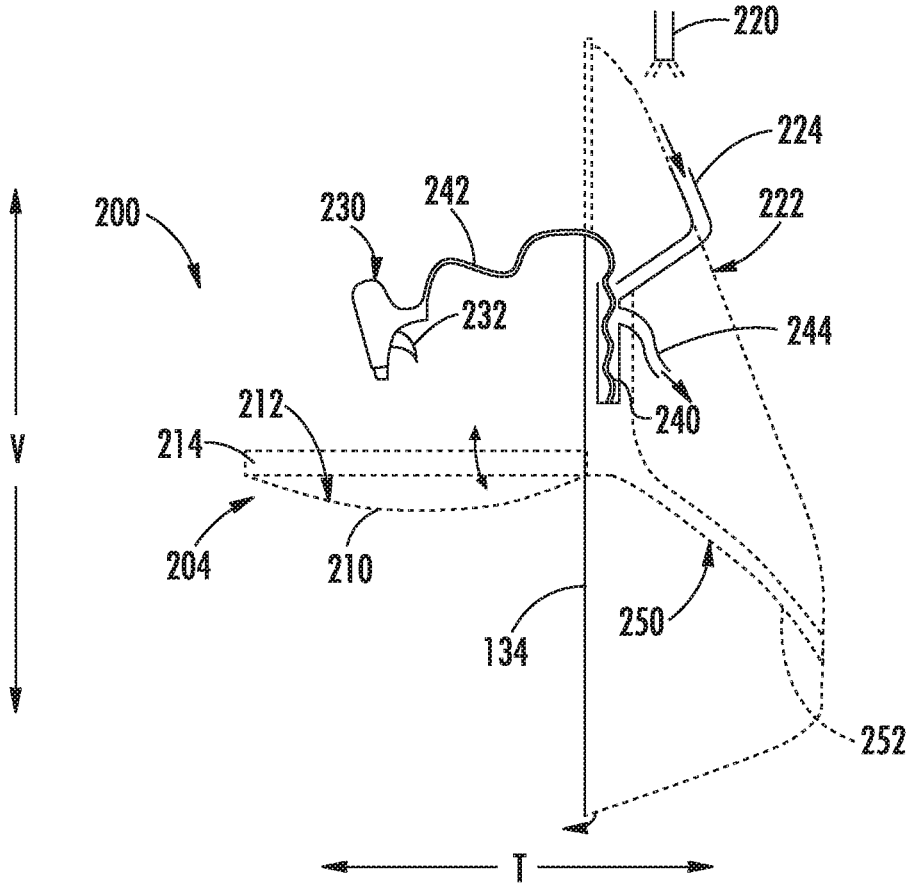
FIG. 5 provides a schematic view of a wash fluid supply and a spray nozzle that may be used with the exemplary door assembly of FIG. 3 according to an exemplary embodiment of the present subject matter.
Figure 6:
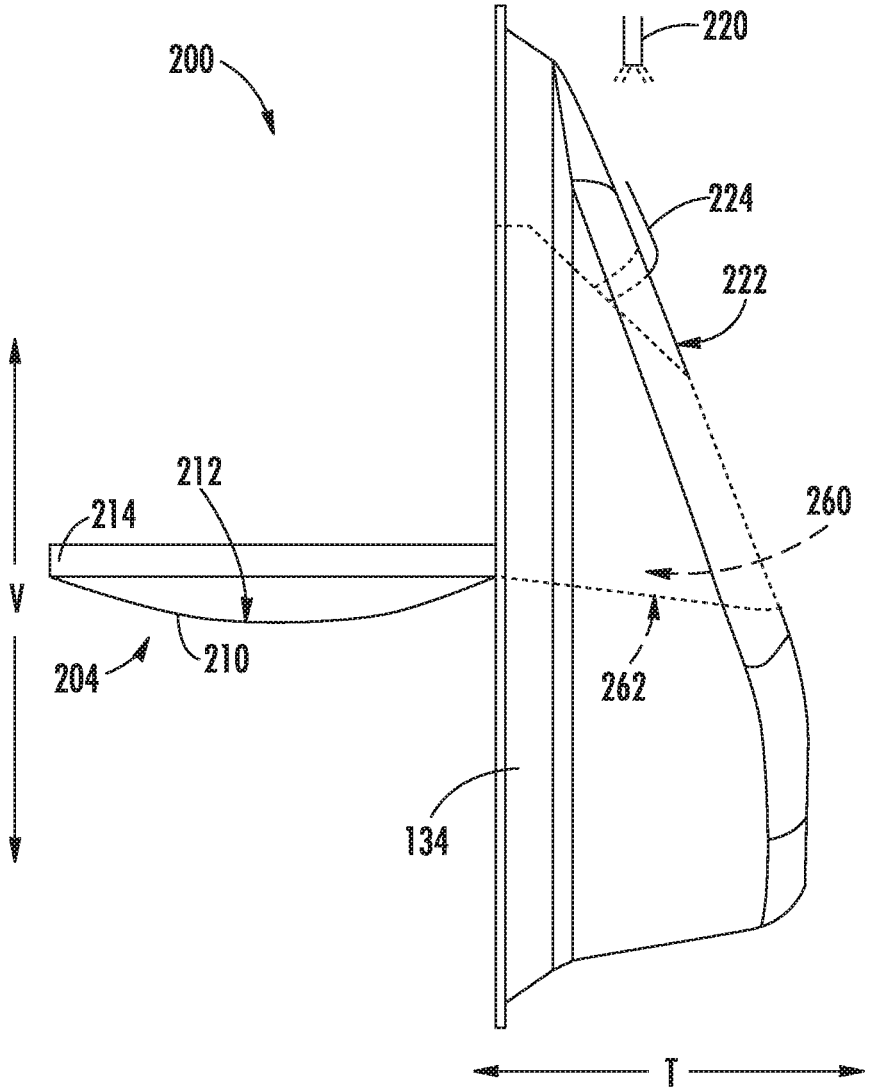
FIG. 6 provides a side view of the exemplary door assembly of FIG. 3 according to another exemplary embodiment of the present subject matter.

Referring now to FIGS. 4 and 5, door assembly 200 may be configured for diverting a portion of the wash fluid from wash fluid supply 220 to sub-door 204 for a pretreatment process. For example, as described above, wash fluid supply 220 directs a flow of wash fluid along back wall 222 of door 134. Door assembly 200 may further include a wash fluid scoop 224 for redirecting a portion of the flow of wash fluid toward pretreat basin 210. For example, wash fluid scoop 224 may be any groove, ribs, gutter, or other suitable feature defined within or extending from back wall 222 for capturing and redirecting a portion of the wash fluid.

Referring now to FIG. 5, the wash fluid supply system will be described in more detail according to an exemplary embodiment. As illustrated, door assembly 200 includes an extendable spray nozzle 230 in fluid communication with wash fluid supply 220. In this manner, spray nozzle 230 is accessible when sub-door 204 is in the open position and permits a user to manually apply wash fluid to selected portions of an article of clothing, e.g., by pulling a trigger 232 to impart a pumping action.

Although FIG. 5 illustrates spray nozzle 230 as supplying wash fluid and trigger 232 as the actuation mechanism, it should be appreciated that any other suitable wash fluid nozzle or delivery mechanism may be used according to alternative embodiments. For example, wash fluid scoop 224 may simply direct all or a portion of the diverted wash fluid directly into pretreat basin 210. Alternatively, washing machine appliance 100 or door assembly 200 may include a button (such as button 162) that is operably coupled with spray nozzle 230 and is configured for discharging wash fluid when button 162 is pressed. Other configurations and mechanisms of wash fluid delivery are possible and within the scope of the present subject matter.

Referring still to FIG. 5, door assembly 200 may further include a reservoir 240 in fluid communication with wash fluid supply 220 for receiving the flow of wash fluid. More specifically, as illustrated, wash fluid scoop 224 directs the collected wash fluid directly into reservoir 240 which is mounted within door 134. Spray nozzle 230 is in fluid communication with reservoir 240 for urging wash fluid from reservoir 240 into pretreat basin 210. More specifically, for example, spray nozzle 230 includes a tube 242 that extends into reservoir 240 for drawing and discharging the collected wash fluid when trigger 232 is pulled.

In order to prevent excess wash fluid from collecting within reservoir 240, door assembly 200 may further include an overflow channel 244 extending between reservoir 240 and wash tub 124 for directing excess wash fluid into wash tub 124. For example, as illustrated, overflow channel 244 is fluidly coupled to a top of reservoir 240, e.g., above an arbitrary max fill line. According to an exemplary embodiment, the max fill line may be selected to ensure that the amount of wash fluid stored in reservoir 240 never exceeds the volumetric capacity of pretreat basin 210, thereby reducing the likelihood of wash fluid overflowing onto the floor. In addition, according to alternative embodiments, door assembly 200 may include a valve (not shown), such as a ball valve, that opens before a wash cycle is initiated to drain any unused pretreatment wash fluid within reservoir 240.

Notably, after the pretreatment operation is completed, it is desirable to direct the leftover wash fluid in pretreat basin 210 into the wash tub 124 or to an external drain. Thus, door assembly 200 may further include a drain assembly 250 that provides fluid communication between pretreat basin 210 and wash tub 124. More specifically, as illustrated in FIGS. 4 and 5, door assembly 200 includes a primary drain conduit 252 through which wash fluid within pretreat basin 210 may drain into wash tub 124. According to the illustrated embodiment, primary drain conduit 252 is simply a sloping conduit that relies on gravity to direct wash fluid to wash tub 124. More specifically, for example, when sub-door 204 is closed, collected wash fluid flows out pretreat basin 210, over peripheral lip 214, and into primary drain conduit 252, where it is directed into wash tub 124.

According to the illustrated embodiment, primary drain conduit 252 is illustrated as being positioned for collecting the flow of wash fluid as sub-door 204 is closed. However, according to alternative embodiments, drain assembly 250 may use any other suitable drain configuration. For example, concave surface 212 may define one or more drain holes (not shown) that continuously drain wash fluid from pretreat basin 210. According to still other embodiment, a pump assembly or other mechanism may be used for pumping or otherwise discharging wash fluid from pretreat basin 210. Other configurations of drain assembly 250 are possible and within the scope of the present subject matter.

Notably, the embodiment of door assembly 200 illustrated in FIGS. 4 and 5 requires a user to pick up the pretreated article of clothing, open door 134, and put the article into wash chamber 126 through opening 132. This may result in excessive manual movement of clothes by a user or dripping of wash fluid on the floor, particularly when the article of clothing has been pretreated with a lot of wash fluid. Thus, referring now to FIG. 6, an alternative embodiment of door assembly 200 will be illustrated. As shown, door 134 defines a door opening 260 that extends through door 134 from outside of the washing machine appliance 100 and into wash tub 124. Sub-door 204 thus provides selective access to door opening 260.

During operation, a user may pretreat an article of clothing within pretreat basin 210 in the same manner as described above with respect to FIGS. 5 and 6. After the pretreatment procedure is complete, a user may simply close sub-door 204, thereby pushing the article of clothing and any wash fluid used during the pretreatment process into wash tub 124. Notably, a bottom wall 262 of opening 260 may be sloped down toward wash tub 124 relative to the transverse direction T to ensure all wash fluid and garments flow into wash tub 124 under the force of gravity. In addition, sub-door 204 may be locked in place during the wash cycle and prevent wash fluid from being discharged through opening 260.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance defining a vertical, a lateral, and a transverse direction, the washing machine appliance comprising:

a cabinet including a front panel, the front panel defining an opening;

a tub positioned within the cabinet;

a wash basket rotatably mounted within the tub, the wash basket defining a wash chamber for receiving articles for washing; and a door assembly positioned proximate the opening, the door assembly comprising:

a door rotatably mounted to the front panel to permit selective access to the opening;

a sub-door rotatably mounted to the door and being movable between an open position and a closed position, the sub-door defining a pretreat basin having a concave surface for collecting wash fluid when the sub-door is in the open position;

a wash fluid supply mounted within the tub above the door along the vertical direction and being configured for selectively supplying a flow of wash fluid along a back wall of the door; and a wash fluid scoop defined within or extending from the back wall for redirecting a portion of the flow of wash fluid toward the pretreat basin.

2. The washing machine appliance of claim 1, wherein the door of the washing machine appliance defines a door opening, the sub-door providing selective access to the door opening.

3. The washing machine appliance of claim 1, further comprising a drain assembly providing fluid communication between the pretreat basin and the tub.

4. The washing machine appliance of claim 3; wherein the drain assembly includes a primary drain conduit defined within the door, the primary drain conduit providing fluid communication between the pretreat basin and the tub.

5. The washing machine appliance of claim 1, wherein the door assembly comprising an extendable spray nozzle in fluid communication with the wash fluid supply, the spray nozzle being accessible when the sub-door is in the open position.

6. The washing machine appliance of claim 5, wherein the door assembly further includes a button that is operably coupled with the spray nozzle, the spray nozzle being configured for discharging wash fluid when the button is pressed.

7. The washing machine appliance of claim 5, wherein the door assembly further comprises a reservoir in fluid communication with the wash fluid supply for receiving the flow of wash fluid, the spray nozzle being in fluid communication with the reservoir for urging wash fluid from the reservoir into the pretreat basin.

8. The washing machine appliance of claim 7, wherein the door assembly comprises an overflow channel extending between the reservoir and the tub for directing excess wash fluid to the tub.

9. The washing machine appliance of claim 1, wherein the wash fluid supply is configured for providing water, detergent, or another wash fluid to the pretreat basin.

10. The washing machine appliance of claim 1, wherein the sub-door is in a substantially horizontal orientation when in the open position.

11. The washing machine appliance of claim 1, wherein the door is rotatable about a door axis, the door axis being substantially parallel to the vertical direction, and wherein the sub-door is rotatable about a sub-door axis, the sub-door axis being substantially parallel to the lateral direction.

12. The washing machine appliance of claim 1, wherein the wash basket is rotatable about an axis of rotation, the axis of rotation being substantially parallel to the transverse direction.

13. A door assembly for a horizontal axis washing machine, the washing machine comprising a cabinet including a front panel defining an opening and a tub positioned within the cabinet, the door assembly comprising:

a door rotatably mounted to the front panel to permit selective access to the opening;

a sub-door rotatably mounted to the door and being movable between an open position and a closed position, the sub-door defining a pretreat basin having a concave surface for collecting wash fluid when the sub-door is in the open position; and a wash fluid supply configured for selectively supplying a flow of wash fluid along a back wall of the door; and a wash fluid scoop defined within or extending from the back wall for redirecting a portion of the flow of wash fluid toward the pretreat basin.

14. The door assembly of claim 13, wherein the door of the washing machine appliance defines a door opening, the sub-door providing selective access to the door opening.

15. The door assembly of claim 13, further comprising:

a primary drain conduit defined within the door, the primary drain conduit providing fluid communication between the pretreat basin and the tub.

16. The door assembly of claim 13, wherein the door assembly comprising an extendable spray nozzle in fluid communication with the wash fluid supply, the spray nozzle being accessible when the sub-door is in the open position.

17. The door assembly of claim 16, wherein the door assembly further comprises a reservoir in fluid communication with the wash fluid supply for receiving the flow of wash fluid, the spray nozzle being in fluid communication with the reservoir for urging wash fluid from the reservoir into the pretreat basin, and wherein the door assembly comprises an overflow channel extending between the reservoir and the tub for directing excess wash fluid to the tub.

* * * * *